United States Patent [19]

Okamoto et al.

[11] 4,165,172

[45] Aug. 21, 1979

[54] DRUM CLEANING SYSTEM FOR ELECTROPHOTOGRAPHIC APPARATUS

[75] Inventors: Toyoo Okamoto; Toshio Watanabe; Akira Midorikawa; Tatsuo Tani; Seiichi Miyakawa, all of Tokyo, Japan

[73] Assignee: Ricoh Co., Ltd., Tokyo, Japan

[21] Appl. No.: 750,770

[22] Filed: Dec. 15, 1976

[30] Foreign Application Priority Data

Dec. 16, 1975 [JP] Japan ..... 50/150416

[51] Int. Cl.[2] ..... G03G 21/00

[52] U.S. Cl. ..... 355/15; 15/256.51

[58] Field of Search ..... 355/15; 15/1.5, 256.51, 15/256.52; 134/6; 118/652

[56] References Cited

U.S. PATENT DOCUMENTS

| | | | |
|---|---|---|---|
| 3,552,850 | 1/1971 | Royka et al. | 15/1.5 R X |
| 3,654,654 | 4/1972 | Abreu et al. | 15/1.5 R |
| 3,656,200 | 4/1972 | Riley | 134/6 X |
| 3,711,796 | 1/1973 | Saito et al. | 15/256.51 X |
| 4,080,059 | 3/1978 | Tani et al. | 355/15 |

*Primary Examiner*—Richard L. Moses

*Attorney, Agent, or Firm*—Frank J. Jordan

[57] ABSTRACT

A spongy roller is rotated so that the surface thereof is pressed against the surface of a photoconductive drum and moves in the opposite direction therefrom. A resilient blade is also pressed against the photoconductive drum downstream of the roller so as to define a trough therebetween into which is supplied a cleaning liquid. The roller and blade remove all residual toner substance from the drum which remains after development and transfer operations. The cleaning liquid is supplied only while the drum is being operatively rotated in a quantity sufficient to wash away substantially all removed toner substance from between the blade and the drum. The roller is large enough to absorb enough cleaning liquid to remain moist and prevent solidification of removed toner substance between the roller and the drum between copying operations and when the apparatus is shut down.

14 Claims, 1 Drawing Figure

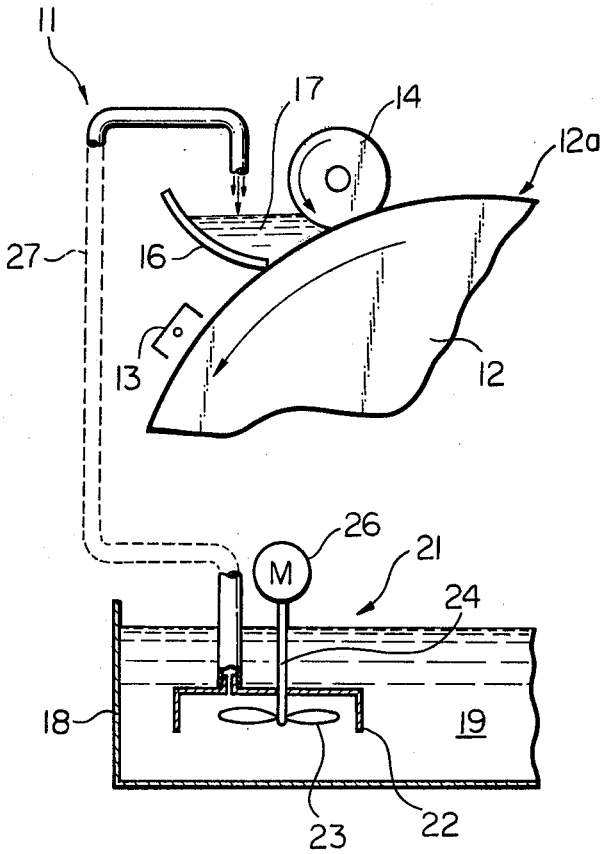
11
17
14
12a
27
16
13
12
26
M
21
24
18
19
23
22

DRUM CLEANING SYSTEM FOR ELECTROPHOTOGRAPHIC APPARATUS

BACKGROUND OF THE INVENTION

The present invention relates to a drum cleaning system for an electrophotographic apparatus.

In an electrophotographic copying machine utilizing semi-moist development, a photoconductive drum or belt is electrostatically charged and radiated with a light image of an original document which causes local photoconduction resulting in an electrostatic image being formed on the drum. A developing liquid containing a toner substance is applied to the drum in such a manner that the toner substance adheres to the areas of the drum in which the electrostatic charge remains, thereby forming a toner image. The toner image is transferred to a copy sheet and fixed thereto to provide a permanent copy of the original document.

However, not all of the toner substance is transferred to the copy sheet during the transfer step and a residual amount remains on the drum. This residual toner substance must be removed from the drum prior to another copying operation to prevent double printing.

Various scraper blades, rollers and the like have been proposed to accomplish the drum cleaning function, but none have proven completely satisfactory in practical application.

SUMMARY OF THE INVENTION

It is therefore an object of the present invention to provide a drum cleaning process for electrophotography which effectively removes residual toner substance from a photoconductive drum after a toner image transfer operation.

It is another object of the present invention to provide a drum cleaning apparatus embodying the method.

It is another object of the present invention to provide a drum cleaning system in which a cleaning liquid is supplied between a spongy roller and a blade to remove residual toner substance from a photoconductive drum in which solidification of the removed toner substance causing sticking of the roller or blade to the drum is effectively prevented.

It is another object of the present invention to provide a generally improved drum cleaning system for an electrophotographic apparatus.

Other objects, together with the foregoing, are attained in the embodiment described in the following description and illustrated in the accompanying drawings.

BRIEF DESCRIPTION OF THE DRAWING

The single FIGURE of drawing is a fragmentary schematic view of an electrophotographic apparatus specifically illustrating a drum cleaning system embodying the present invention.

DESCRIPTION OF THE PREFERRED EMBODIMENT

While the drum cleaning system for electrophotographic apparatus of the invention is susceptible of numerous physical embodiment, depending upon the environment and requirements of use, substantial numbers of the herein shown and described embodiments have been made, tested and used, and all have performed in an eminently satisfactory manner.

Referring now to the drawing, an electrophotographic apparatus is shown in fragmentary form and designated as 11. The apparatus 11 comprises a drum 12 formed with a photoconductive surface layer (not designated) and is driven for rotation in the counterclockwise direction. A charging unit 13 charges the surface of the drum 12 with an electrostatic potential. Although not illustrated, a conventional imaging unit radiates the surface of the drum 12 with a light image of an original document causing local photoconduction and the formation of an electrostatic image on the drum 12. A liquid developer containing a toner substance is applied to the drum 12 to develop the electrostatic image into a visible toner image which is transferred and fixed to a copy sheet to provide a permanent copy of the original document.

However, not all of the toner substance is transferred to the copy sheet and a residual amount remains thereon after the transfer operation. If the residual toner substance is not removed from the drum 12 prior to subsequent charging by the charging unit 13 for another copying operation the residual toner image will be superimposed on the subsequently formed image to constitute double printing.

To effectively remove this residual toner substance, a spongy cleaning roller 14 is pressed into contact with the drum 12 and rotated in the counterclockwise direction so that the contacting surfaces of the drum 12 and roller 14 move in opposite directions. The roller 14 is disposed downstream and below the uppermost portion of the drum 12, which is indicated at **12*a*, in the direction of movement (counterclockwise) of the drum 12**.

In addition, a resilient cleaning blade 16 made of rubber or the like is pressed against the drum 12 downstream and below the roller 14 in the counterclockwise direction of rotation of the drum 12. The roller 14 and blade 16 define therebetween a trough 17.

The roller 14 and blade 16 are coextensive in length with the drum 12 so that the trough 17 is open at its ends. The ends of the trough 17 open above and into a tank 18 which contains a cleaning liquid 19. It is convenient to utilize as the cleaning liquid 19 the developing liquid which is utilized in the electrophotographic process so that the residual toner substance removed from the drum 12 may be recycled.

A pump 21 comprises a housing 22 which is immersed in the liquid 19 in the tank 18 and an impeller 23 operatively rotatably disposed in the housing 22. The impeller 23 is rotatably through a shaft 24 by a motor 26 to pump the liquid 19 from the tank 18 into the trough 17 through a pipe 27.

In operation, the drum 12 is driven for rotation relative to the roller 14 and blade 16 and the motor 26 is energized to pump the liquid 19 onto the trough 17. The spongy roller 14 absorbs the liquid 19 to saturation, and wipingly removes the residual toner substance from the surface of the drum 12. The toner substance removed by the roller 14 becomes suspended in the liquid 14 in the trough 17 upon further rotation of the roller 14 and is carried away by the flow of the liquid 19 through the trough 17 into the tank 18. Preferably, the pipe 27 opens into the center of the trough 17 so that the liquid 19 flows equally from the center of the trough 17 and spills out of the ends of the trough 17 into the tank 18.

Although most of the residual toner substance is removed by the roller 14, a certain amount remains and is scrapingly removed by the blade 16. This toner substance is carried away from the area of contact between the blade 16 and drum 12 by the flow of the liquid 19.

In order that the present invention provide satisfactory service is practical application, it is necessary that the residual tone substance removed from the drum 12 not be allowed to accumulate and solidify between the roller 14 and blade 16 and the drum 12. If, between copying cycles and when the apparatus 11 is shut down the flow of the liquid 19 is stopped so that toner substance trapped between the roller 14 and blade 16 and the drum 12 is allowed to dry out and solidify, it will cause the roller 14 and blade 16 to stick to the drum 12 thereby damaging the delicate photoconductive layer unless suitable precautions are taken.

In the development of the present invention the expedient of starting the supply of the liquid 19 a suitable length of time before starting a copying operation, maintaining the supply of the liquid 19 between copying cycles and maintaining the supply of the liquid 19 for a suitable length of time after the copying operation was completed to ensure that all removed toner substance would be returned to the tank 18 was undertaken. However, this expedient suffers from the drawbacks that an unnecessary delay before starting the copying operation is introduced and that the prolonged supply of the liquid 19 causes excessive evaporation and concentration of the toner substance in the liquid 19. The present invention in its perfected form, however, overcomes these problems without introducing any drawbacks.

In accordance with the invention, the motor 26 is energized to effect supply of the liquid 19 into the trough 17 only when the drum 12 is driven for rotation, thereby eliminating any unnecessary delays and evaporation of the liquid 19. In order to ensure that no toner substance remains in the area of contact between the blade 16 and the drum 12 after the supply of the liquid 19 is terminated, the capacity of the pump 21 is selected to be large enough to provide sufficient flow through the trough 17 to continuously was removed toner substance away from the blade 16 as it is scrapingly removed thereby from the drum 12. Thus, accumulation of removed toner substance between the blade 16 and drum 12 is prevented and the blade 16 will not stick to the drum 12 even if the apparatus 11 is shut down for a prolonged length of time.

In order to prevent sticking of the roller 14 to the drum 12 due to accumulated and dried toner substance the absorbent capacity of the roller 14 is selected to be large enough so that the roller 14 will not dry out even if the apparatus 11 is shut down for a prolonged length of time. Since the roller 14 and the toner substance thereon do not dry out, the toner substance cannot solidify and cause the roller 14 to stick to the drum 12.

In summary, it will be seen that the present invention effectively removes residual toner substance from the surface of a photoconductive drum and prevents a spongy roller and resilient blade which are utilized to effect the removal from sticking to the drum when the apparatus is shut down. Additional benefits of the invention are an increase in copying efficiency and a reduction in operating cost which is made possible through recycling of the toner substance.

Many modifications, such as replacing the roller 14 with a non-rotating spongy member, will become possible for those skilled in the art after receiving the teachings of the present disclosure without departing from the scope thereof.

What is claimed is:

1. In an electrophotographic apparatus including a movable photoconductive member and a developing liquid containing a toner substance applied to the photoconductive member to develop an electrostatic image thereon, the combination comprising:

a spongy cleaning member in pressing contact with the photoconductive member below and downstream of an uppermost portion of the photoconductive member in a direction of movement thereof;

a cleaning blade in pressing contact with the photoconductive member below and downstream of the spongy cleaning member in said direction of movement of the photoconductive member, the photoconductive member, the spongy cleaning member and the cleaning blade defining a trough; and means for supplying a cleaning liquid to the trough in a quantity sufficient to wash way substantially all residual toner substance from between the cleaning blade and the photoconductive member, the spongy cleaning member having an absorbent capacity for the cleaning liquid sufficient to prevent solidification of the toner substance between the spongy cleaning member and the photoconductive member after supply of the cleaning liquid is completed.

2. An apparatus as in claim 1, wherein the spongy member is arranged to be disposed in the trough to absorb the cleaning liquid in the trough.

3. An apparatus as in claim 1, in which the developing liquid is utilized as the cleaning liquid.

4. An apparatus as in claim 1, in which the spongy cleaning member is a roller.

5. An apparatus as in claim 4, in which the roller is rotated in a direction opposite to said direction of movement of the photoconductive member.

6. An apparatus as in claim 1, in which said means comprises a pump.

7. An apparatus as in claim 1, in which the cleaning blade is formed of a resilient material.

8. An apparatus as in claim 1, in which the photoconductive member is a drum.

9. An apparatus as in claim 1, wherein the trough extends generally the longitudinal length of the photoconductive member, the means for supplying a cleaning liquid being disposed to supply the cleaning liquid to a generally longitudinal central portion of the trough such that the cleaning liquid flows towards both longitudinal ends of the trough.

10. An apparatus as in claim 9, wherein the trough has longitudinal ends which are open, the cleaning liquid flowing out of the trough through said open ends.

11. An apparatus as in claim 1, wherein the photoconductive member has a cylindrical configuration, the blade being located above a horizontal plane passing through the longitudinal axis of the cylindrical photoconductive member such that at least a portion of the bottom of the trough is defined by the photoconductive member, whereby the cleaning liquid in the trough is in direct contact with the photoconductive member.

12. In an electrophotographic process in which an electrostatic image formed on a movable photoconductive member is developed using a toner substance, the steps for removing residual toner substance from the photoconductive member after the electrostatic image is developed comprising:

(a) pressing a spongy cleaning member against the photoconductive member below and downstream of an uppermost portion of the photoconductive member in a direction of movement thereof;

(b) pressing a cleaning blade against the photoconductive member below and downstream of the spongy cleaning member in said direction of movement of the photoconductive member;

(c) moving the photoconductive member relative to the spongy cleaning member and cleaning blade in said direction of movement; and (d) supplying a cleaning liquid to a trough defined by the photoconductive member, the spongy cleaning member and the cleaning blade while the photoconductive member is moving in a quantity sufficient to wash away substantially all residual toner substance from between the cleaning blade and the photoconductive member, the spongy cleaning member having and absorbent capacity for the cleaning liquid sufficient to prevent solidification of the toner substance between the spongy cleaning member and the photoconductive member after the completion of step (c).

13. In an electrophotographic process as in claim 12, comprising disposing the spongy member in the trough to absorb the cleaning liquid in the trough.

14. In an electrophotographic process as in claim 12, wherein said trough extends generally the longitudinal length of the photoconductive member, supplying said cleaning liquid to a generally longitudinally central portion of the trough, and causing the cleaning liquid to flow from said central portion to both longitudinal ends of the trough.

* * * * *